US006883276B1

(12) United States Patent
Hannan et al.

(10) Patent No.: US 6,883,276 B1
(45) Date of Patent: Apr. 26, 2005

(54) WINDOW JAMB LINER ASSEMBLY

(75) Inventors: John M. Hannan, Peosta, IA (US); Paul J. Blasen, Dubuque, IA (US)

(73) Assignee: Eagle Window & Door, Inc., Dubuque, IA (US)

( * ) Notice: Subject to any disclaimer, the term of this patent is extended or adjusted under 35 U.S.C. 154(b) by 0 days.

(21) Appl. No.: 10/291,045

(22) Filed: Nov. 8, 2002

(51) Int. Cl.[7] ..... E05D 15/16
(52) U.S. Cl. ..... 49/428
(58) Field of Search ..... 49/454, 194, 163, 49/176, 181, 428, 414, 415, 416; 52/718.04

(56) References Cited

U.S. PATENT DOCUMENTS 2,843,233 A * 7/1958 Walsh ..... 49/431
6,122,864 A 9/2000 Martin
6,305,126 B1 10/2001 Hendrickson et al.

* cited by examiner

*Primary Examiner*—Jerry Redman
(74) *Attorney, Agent, or Firm*—Rader, Fishman & Grauer PLLC

(57) ABSTRACT

A window jamb liner assembly for use in the jamb of an architectural window is provided. The jamb liner assembly includes a longitudinally elongated jamb liner having a pair of spaced-apart channel guides. Each channel guide includes a recess in a forward surface thereof and a bracket that extends into the space defined between the channel guides. A jamb liner cover is cooperatively retained by each of the brackets and covers one of the recesses in the forward surface of one of the channel guides. A weather stripping member for sealingly engaging the sash assemblies of the window is disposed in the other one of the recesses of the channel guides and is retained within the bracket of the channel guide having the recess within which the weather stripping member is disposed.

21 Claims, 5 Drawing Sheets

WINDOW JAMB LINER ASSEMBLY

BACKGROUND OF THE INVENTION

1. Field of the Invention

The present invention relates to architectural window jambs, and more particularly to an aesthetically pleasing window jamb liner assembly mountable in the jambs of a double hung window for sealing engagement with the sash assemblies thereof.

2. Description of the Related Art

Double hung window assemblies generally include a frame, an upper window sash, a lower window sash, and a pair of window jambs. A jamb liner is typically attached to each of the window jambs to guide movement of the window sashes. Due to the tendency of moisture, dirt and other debris to infiltrate the space between the sashes and the window jambs, the jamb liners typically include longitudinally extending weather stripping to provide a seal between the window jambs and the window sashes. Those skilled in the art continue to attempt to improve or enhance the current jamb liner designs, particularly to improve the sealing performance between the sashes and the window jambs, to accommodate new designs and configurations of architectural windows, and to reduce the complexity in manufacturing these window assemblies.

SUMMARY OF THE INVENTION

A window jamb liner assembly for use in the jamb of an architectural window is provided. The jamb liner assembly includes an elongated jamb liner having a pair of spaced-apart channel guides. Each channel guide includes a recess in a forward surface thereof and a bracket that extends into the space defined between the channel guides. A jamb liner cover is cooperatively retained by each of the brackets and covers one of the recesses in the forward surface of one of the channel guides. A weather stripping member for sealingly engaging the sash assemblies of the window is disposed in the other one of the recesses of the channel guides and is retained within the bracket of the channel guide having the recess within which the weather stripping member is disposed.

Various additional aspects of this invention will become apparent to those skilled in the art from the following detailed description of the preferred embodiment, when read in light of the accompanying drawings.

DESCRIPTION OF THE PREFERRED EMBODIMENTS

Figure 1:
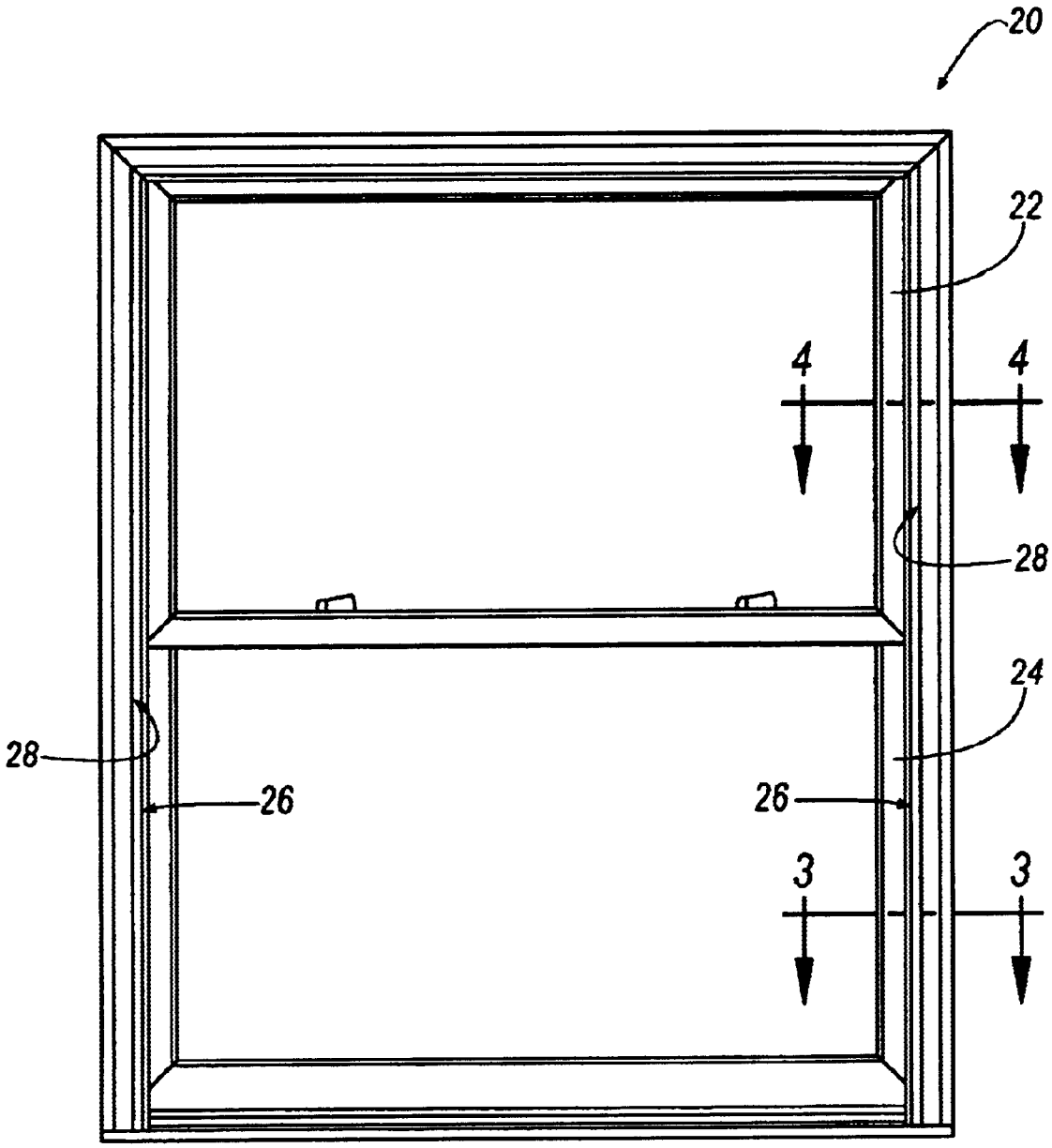
FIG. 1 is an elevational view of a double hung window assembly that employs the jamb liner assembly of the present invention.

Referring now to the drawings, preferred embodiments of the present invention are shown in detail. Referring to FIG. 1, there is shown an architectural window assembly 20 commonly referred to as a double hung window. Window assembly 20 includes an upper window sash 22 and a lower window sash 24, which are supported by a pair of jamb liner assemblies 26 according to the present invention. Each jamb liner assembly 26 is located in a window jamb 28 of window assembly 20. Window jamb 28, as employed in a double hung window assembly, typically includes interior and exterior finished surfaces to aesthetically complement the interior and exterior trim, respectively, of window assembly 20.

Figure 2:
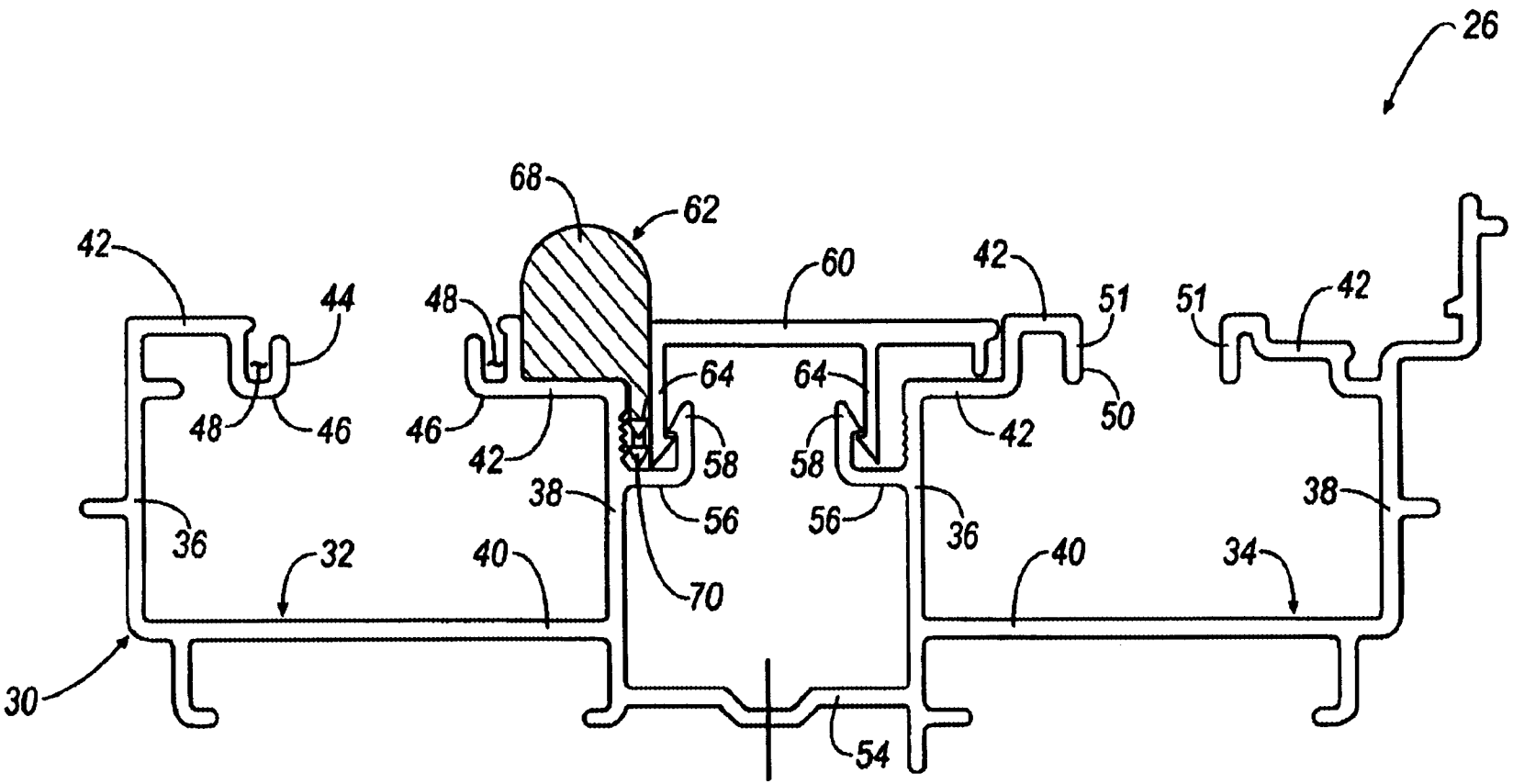
FIG. 2 is an enlarged sectional view illustrating the jamb liner assembly of the present invention.

Referring to FIG. 2, jamb liner assembly 26 includes a longitudinally elongated jamb liner 30 having a pair of elongated channel guides, namely an interior channel guide 32 (i.e., interior to the structure within which window assembly 20 is disposed) and an exterior channel guide 34. Jamb liner 30 is generally constructed of a rigid or semi-rigid material, such as polyvinyl chloride (PVC) or other thermoplastic elastomer; however, other extrudable materials, such as aluminum, may also be used. Each channel guide 32, 34 is generally rectangular shaped, having a pair of opposing wall sections, namely inner 36 and outer 38 wall sections, and rear 40 and forward 42 wall sections. Interior channel guide 32 is configured to guide lower window sash 24 and exterior channel guide 34 is configured to guide upper window sash 22. Channels guides 32, 34 permit each window sash 22, 24 to slide vertically and also preferably allow each window sash 22, 24 to tilt from the window frame, in response to forces exerted thereon. The width of channel guides 32, 34 permits jamb liner assembly 26 to receive two block and tackle balance bars (not shown, but known in the art), unlike the channel guides of prior art jamb liner assemblies that are only wide enough to receive one block and tackle balance bar. This feature allows a single jamb liner assembly 26 to be employed in double hung window assemblies of various sizes and configurations.

Figures 3, 4:
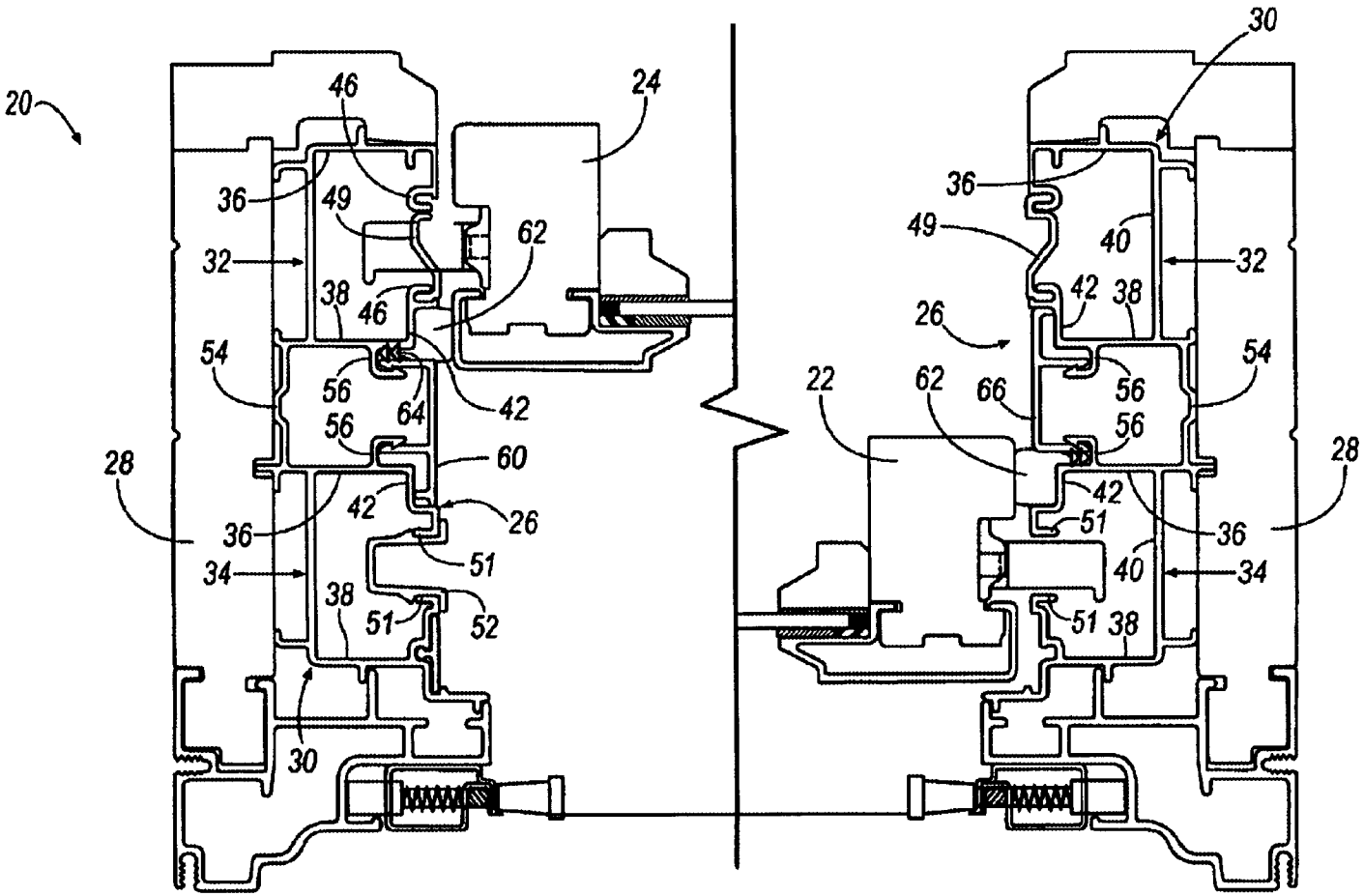
FIG. 3 is a sectional view taken along lines 3—3 of FIG. 1 illustrating a lower portion of the jamb liner assembly of the present invention.
FIG. 4 is a sectional view taken along lines 4—4 of FIG. 1 illustrating an upper portion of the jamb liner assembly of the present invention.

Forward wall section 42 of interior channel guide 32 includes a longitudinally extending aperture 44 therethrough, which is defined on either side by a pair of U-shaped retaining formations 46. A portion of forward wall section 42 projects orthogonally into an engagement area 48 defined by retaining formations 46. A first channel guide cover 49 is pressed into retaining formations 46, as shown in FIGS. 3 and 4, to cover at least a portion of aperture 44 in a longitudinal direction. Lower window sash 24 is engaged with first channel guide 49 through an aperture therein, such that any components received within interior channel guide 32 are substantially hidden. Additionally, a portion of forward wall section 42 adjacent outer wall section 38 is recessed relative to the portion of forward wall section 42 adjacent inner wall section 36.

Forward wall section 42 of exterior channel guide 34 also includes a longitudinally extending aperture 50 therethrough. However, unlike interior channel guide 32, aperture 50 is defined by a pair of L-shaped elbows 51. A second channel guide cover 52 (FIGS. 3 and 4) is pressed into aperture 50 and retained therein by a pair of barbs that engage a distal end of elbows 51. A portion of aperture 50 remains uncovered by second channel guide cover 52 to allow a portion of exterior sash assembly to be received between and guided by elbows 51. Additionally, a portion of forward wall section 42 adjacent inner wall section 36 is recessed relative to the portion of forward wall section 42 adjacent elbows 51.

Interior and exterior channel guide 32, 34 are spaced apart by an integral wall member 54 that extends therebetween. Outer wall section 38 of interior channel guide 32 and inner wall section 36 of exterior channel guide 34 each include an L-shaped bracket 56 that extends into the space defined between the channel guides. Each bracket 56 includes a barbed end 58 that tapers from an outward tip inwardly toward each bracket's corresponding wall segment. In the illustrated embodiment, the width of channel guides 32, 34, measured between inner and outer wall sections 36 and 38, is greater than the width of the space between the channel guides.

Referring to FIGS. 3 and 4, the jamb liner assemblies 26 are shown installed in the jambs 28 of window assembly 20. The lower portion of leftmost jamb liner assembly 26, which is shown in FIG. 3, cooperates with the interior or lower sash assembly 24. The upper portion of the rightmost jamb liner assembly 26, which is shown in FIG. 4, cooperates with the exterior or upper sash assembly 22.

The lower portion of the leftmost jamb liner assembly 26 (FIG. 3) includes a decorative jamb liner cover 60 that is cooperatively retained by each of brackets 56. Jamb liner cover 60 is made of a durable, weather-resistant material, such as PVC or aluminum, which can be painted or otherwise decorated to match the exterior trim of window assembly 20. Jamb liner cover 60 extends over the space between brackets 56 and covers the recess in forward surface 42 of exterior channel guide 34. Prior to attaching jamb liner cover 60 to jamb liner 30, at least one fastener 61, such as a screw, is inserted through wall member 54 into jamb 28 to secure jamb liner assembly 26 to jamb 28.

The uncovered recess in forward surface 42 of interior channel guide 32 receives a weather stripping member 62, which is anchored in bracket 56 between a connecting hook 64 on jamb liner cover 60 and outer wall section 38. As shown in FIG. 2, a portion of outer wall section 38 adjacent bracket 56 is preferably serrated to facilitate retention of weather stripping member 62 within bracket 56. Weather stripping member 62 sealingly engages lower sash 24 to inhibit the passage of moisture, dirt and other debris between jamb liner assembly 26 and lower sash 24.

Referring to FIG. 4, the upper portion of the rightmost jamb liner assembly 26 also includes a decorative jamb liner cover 66 that is cooperatively retained by each of brackets 56. Jamb liner cover 66 is made of wood veneer wrapped PVC or other suitable interior trim material, which can be painted or otherwise decorated to match the interior trim of window assembly 20. Jamb liner cover 66 extends over the space between brackets 56 and covers the recess in the forward surface 42 of interior channel guide 32. The uncovered recess in forward surface 42 of exterior channel guide 34 receives weather stripping member 62, which is anchored in bracket 56, as described above. In either configuration of jamb liner assembly 26, the unoccupied recessed portion of the forward wall section 42 is hidden or disguised, which provides a uniform exterior or interior finished surface for window jambs 28.

Referring again to FIG. 2, weather stripping members 62 include an elongated sealing element 68 made from a resiliently compressible material, such as urethane, which is carried by an anchor member 70. The base of each weather stripping member 62 is received in the recessed portion of forward wall section 42. Anchor member 70 may include one or more barbs to facilitate retention of weather stripping member 62 within brackets 56, particularly against the serrations in outer wall section 38. In the illustrated embodiment, the barbs are generally triangular in shape with a first edge engaging the serrated wall section 38 and an opposing edge abutting connecting hook 64.

Figure 5:
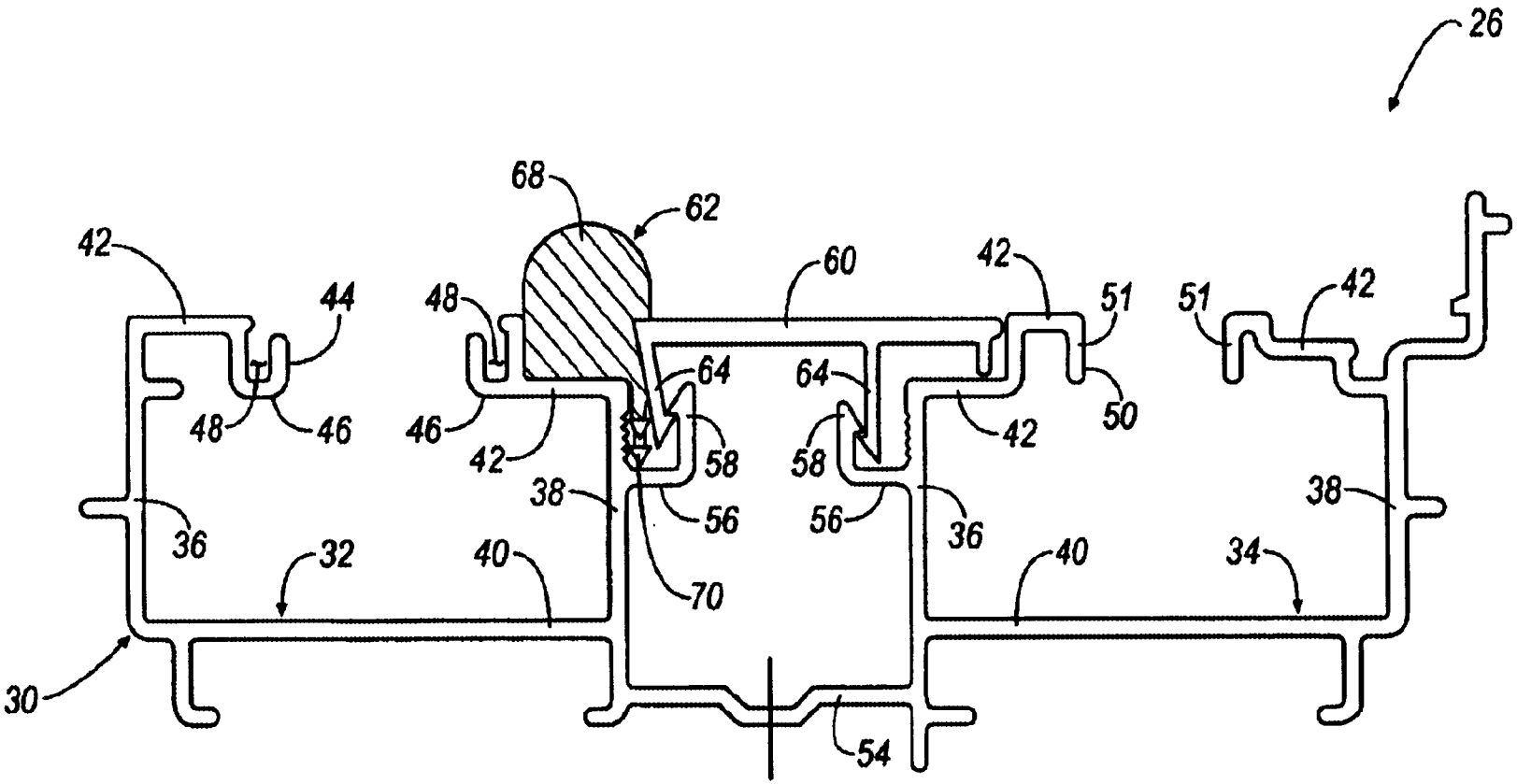
FIG. 5 is an enlarged sectional view illustrating the jamb liner assembly according to an alternate embodiment of the present invention.

The width of the interior of bracket 56 is approximately equal to the combined width of connecting hook 64 and anchor member 70. Additionally, due to the orientation of cover 60 in relation to weather stripping member 62, connecting hook 64 can be used to impart a compressive force against weather stripping member 62 to help facilitate retention of weather stripping member 62 within bracket 56. Moreover, as illustrated in the alternate embodiment of FIG. 5, connecting hook 64 may be slightly angled to further compress weather stripping member 62 to facilitate retention thereof.

Figure 6:
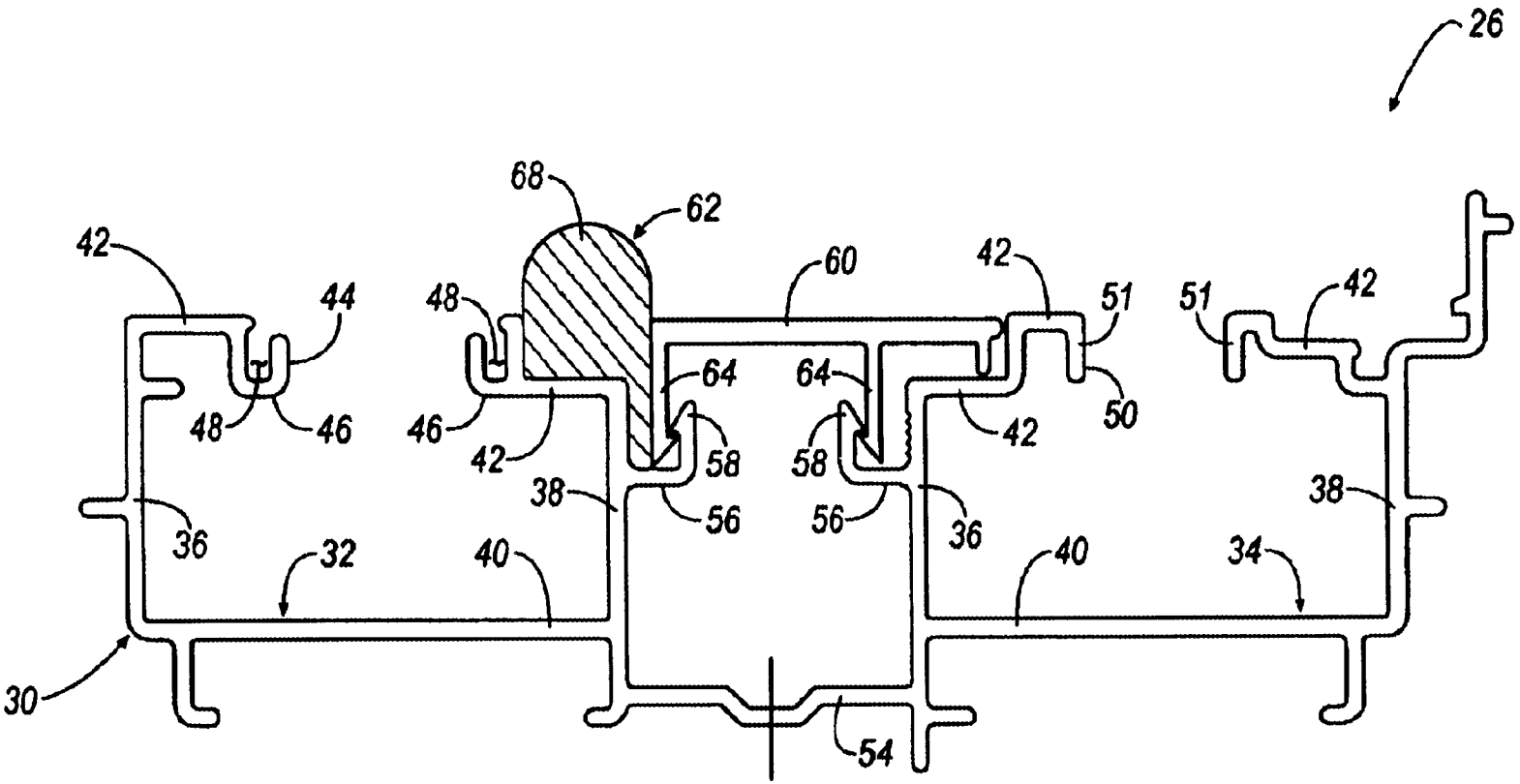
FIG. 6 is an enlarged sectional view illustrating the jamb liner assembly according to another alternate embodiment of the present invention.

Referring to FIG. 6, another embodiment of the weather stripping member and cover are shown. In this embodiment, the weather stripping member and cover are integrally formed to create a weather stripping cover assembly 72. Weather stripping cover assembly 72 is formed by molding the weather stripping portion of assembly 72 to the cover portion thereof, or by adhering the weather stripping portion to the cover using an adhesive for example. As will be appreciated, the unitary weather stripping cover assembly 72 reduces the cost and complexity of manufacturing jamb liner assembly 26.

Although certain preferred embodiments of the present invention have been described, the invention is not limited to the illustrations described and shown herein, which are deemed to be merely illustrative of the best modes of carrying out the invention. A person of ordinary skill in the art will realize that certain modifications and variations will come within the teachings of this invention and that such variations and modifications are within its spirit and the scope as defined by the claims.

What is claimed is:

1. A window jamb liner assembly comprising:

an elongated jamb liner having a pair of spaced-apart channel guides, each channel guide defining a recess in a forward surface thereof and including an adjacent bracket that extends into the space defined between the channel guides;

a jamb liner cover cooperatively retained by each of the brackets and covering one of the recesses in the forward surface of one of the channel guides, the cover includes a connecting hook that is angled with and secured to the brackets, the cover compressively engages a weather stripping member; and the weather stripping member disposed in the other one of the recesses of the channel guides, the weather stripping member being retained within the bracket of the channel guide having the recess within which the weather stripping member is disposed.

2. The jamb liner assembly of claim 1, wherein the weather stripping member includes a sealing portion and an anchor member, the sealing portion being received in the recessed forward surface of the channel guide and the anchor member being secured in the bracket.

3. The jamb liner assembly of claim 2, wherein an interior width of the bracket is approximately equal to the width of the anchor member and a portion of the cover retained by the bracket.

4. The jamb liner assembly of claim 2, wherein the anchor member engages a first wall comprising a first material and a second wall comprising a second material.

5. The jamb liner assembly of claim 2, wherein the anchor member includes at least one barb that engages the channel guide and the cover.

6. The jamb liner assembly of claim 1, wherein the width of the channel guides is greater than the space between the channel guides.

7. The jamb liner assembly of claim 1, wherein the forward surface of each channel guide defines an elongated aperture that is covered by a channel guide cover.

8. The jamb liner assembly of claim 7, wherein each side of the aperture is defined by a channel guide bracket within which a portion of the channel guide cover is received to affix the channel guide cover to the corresponding channel guide.

9. The jamb liner assembly of claim 7, wherein each side of the aperture is defined by an elbow against which a portion of the channel guide cover is engaged to affix the channel guide cover to the corresponding channel guide.

10. The jamb liner assembly of claim 1, wherein the weather stripping member is integrally formed with the jamb liner cover.

11. The jamb liner assembly of claim 1, wherein the weather stripping member is adhered to the jamb liner cover.

12. A window jamb liner assembly comprising:

an elongated jamb liner having a pair of spaced-apart channel guides, each channel guide defining a recess in a forward surface thereof and including a bracket that extends into the space defined between the channel guides and proximate each channel guide;

a jamb liner cover cooperatively retained by each of the brackets and covering one of the recesses in the forward surface of one of the channel guides; and the weather stripping member disposed in the other one of the recesses of the channel guides, the weather stripping member being retained within the bracket of the channel guide having the recess within which the weather stripping member is disposed, the weather stripping member includes a sealing portion and an anchor member, the sealing portion being received in the recessed forward surface of the channel guide and the anchor member being secured in the bracket, the anchor member includes at least one barb that engages the channel guide and the cover.

13. The jamb liner assembly of claim 12, wherein an interior width of the bracket is approximately equal to the width of the anchor member and a portion of the cover retained by the bracket.

14. The jamb liner assembly of claim 12, wherein the anchor member engages a first wall comprising a first material and a second wall comprising a second material.

15. The jamb liner assembly of claim 12, wherein the width of the channel guides is greater than the space between the channel guides.

16. The jamb liner assembly of claim 12, wherein the forward surface of each channel guide defines an elongated aperture that is covered by a channel guide cover.

17. The jamb liner assembly of claim 16, wherein each side of the aperture is defined by a channel guide bracket within which a portion of the channel guide cover is received to affix the channel guide cover to the corresponding channel guide.

18. The jamb liner assembly of claim 16, wherein each side of the aperture is defined by an elbow against which a portion of the channel guide cover is engaged to affix the channel guide cover to the corresponding channel guide.

19. The jamb liner assembly of claim 12, wherein the weather stripping member is integrally formed with the jamb liner cover.

20. The jamb liner assembly of claim 12, wherein the weather stripping member is adhered to the jamb liner cover.

21. The jamb liner assembly of claim 12, wherein the cover includes a connecting hook that is angled with and secured to the brackets, the cover compressively engages a weather stripping member.

* * * * *